US007182539B2

(12) United States Patent
Pan et al.

(10) Patent No.: US 7,182,539 B2
(45) Date of Patent: Feb. 27, 2007

(54) SLIDING PISTON OPENING MEANS

(75) Inventors: Shun-I Pan, San Gabriel, CA (US); Tawei Tsao, Diamond Bar, CA (US); Garry Tsaur, 19222 Tranbarger St., Rowland Heights, CA (US) 91748

(73) Assignee: Garry Tsaur, Rowland Heights, CA (US)

( * ) Notice: Subject to any disclaimer, the term of this patent is extended or adjusted under 35 U.S.C. 154(b) by 0 days.

(21) Appl. No.: 10/723,025

(22) Filed: Nov. 26, 2003

(65) Prior Publication Data

US 2005/0111902 A1 May 26, 2005

(51) Int. Cl.

| | |
|---|---|
| ***B43M 11/06*** | (2006.01) |
| ***B43K 5/06*** | (2006.01) |
| ***B65D 37/00*** | (2006.01) |
| ***A61M 35/00*** | (2006.01) |

(52) U.S. Cl. ..... 401/186; 401/183; 401/176; 222/212; 222/213; 604/2

(58) Field of Classification Search ..... 401/183–186, 401/176–182; 604/1–3; 222/206, 207, 209, 222/212, 213, 215

See application file for complete search history.

(56) References Cited

U.S. PATENT DOCUMENTS 6,484,906 B2 * 11/2002 Bonningue ..... 222/207

* cited by examiner

*Primary Examiner*—David J. Walczak
(74) *Attorney, Agent, or Firm*—Joe Nieh

(57) ABSTRACT

A sliding piston opening means enclosed within an elongated container to release the fluid sealed within the elongated container by squeezing the elongated container at or near the sliding piston. After the sliding piston opening means is opened, the fluid sealed within the elongated container is released for application. Before the content of the container is depleted, the sliding piston opening means is used to re-close the opening thereby re-sealing the fluid remaining within the container.

5 Claims, 10 Drawing Sheets

SLIDING PISTON OPENING MEANS

BACKGROUND

1. Field of Invention

The present invention relates generally to an opening means for use in an elongated container to release a fluid enclosed within the elongated container.

2. Description of Related Art

A variety of opening means exist for opening a container. Most opening means are in the form of a screw-on cap or a snap-on cap. Some opening means are in the form of a frangible seal or a score line on the container that will allow the contents of the container to be released upon fracturing of the frangible seal or the container at the score line. All of these opening means are either attached to the container externally, such as the screw-on cap and the snap-on cap, or are formed as part of the container, such as the frangible seal and the score line on the container. None of the opening means are designed to be enclosed within the container to seal a fluid in the container and yet still allow the release of the fluid easily and reliably and also allow re-closing of the opening. The availability of an effective and easy to use opening means is particularly lacking for a small elongated container with a small cross-sectional area.

SUMMARY OF THE INVENTION

The present invention is a sliding piston opening means fully enclosed within an elongated container to release the fluid sealed within the elongated container. The sliding piston opening means is operated by squeezing the elongated container at or near the sliding piston. Once the sliding piston opening means is opened, the fluid sealed within the elongated container is released for application. Before the content of the container is depleted, the sliding piston opening means is used to re-close the opening thereby re-sealing the fluid remaining within the container. When the sliding piston opening means is used as an opening means for a specimen collector, the sliding piston opening means may be first opened to allow retrieval of the specimen and then closed to seal-in the collected specimen.

DETAILED DESCRIPTION OF THE PREFERRED EMBODIMENT

Figure 1:
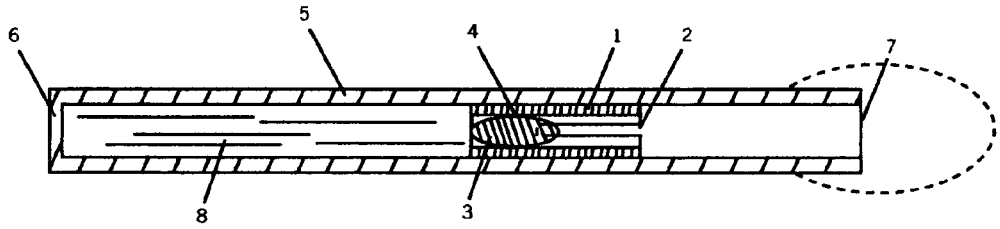
FIG. 1 shows a cross-sectional view of the preferred embodiment of the sliding piston opening means in the closed position.
Figure 2:
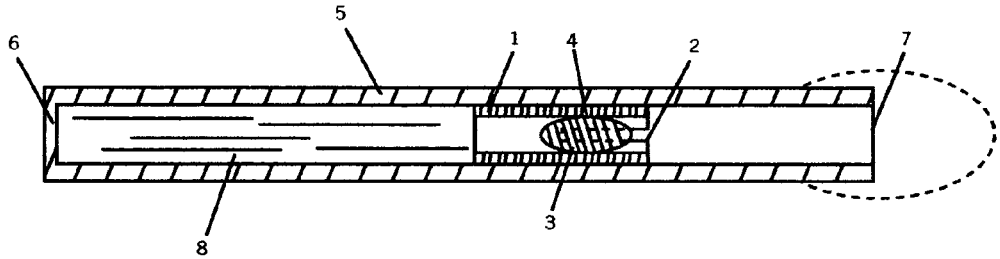
FIG. 2 shows a cross-sectional view the preferred embodiment of the sliding piston opening means in the open position.

FIGS. 1 and 2 show the preferred embodiment of the sliding piston opening means. In the preferred embodiment, the sliding piston opening means comprises of a section of a tube 1 with an opening 2 such as a slit through part of its length with an elliptical shaped piston 3 with a sealing diameter 4 between its two ends approximately that of the inside diameter of the tube 1 disposed within the tube 1. An 0-ring may be disposed at the sealing diameter 4 to provide the sealing function. The sliding piston opening means is affixed inside a compressible elongated tubular housing 5 with a sealed end 6 and an open end 7 and with approximately the same inside diameter as the outside diameter of the sliding piston opening means. Alternatively, the section of tube 1 of the sliding piston opening means and the compressible elongated tubular housing 5 may be formed as a single unit with the section of tube 1 being in the form of a reduced diameter within the compressible elongated tubular housing. One or both ends of the elongated tubular housing 5 may optionally be covered with an applicator. A fluid 8 is enclosed within the compressible elongated tubular housing 5 near the sealed end 6. The sliding piston opening means separates the fluid 8 from the open end 7 of the compressible elongated tubular housing 5 thereby sealing the fluid 8 within the compressible elongated tubular housing 5. The sliding piston opening means is operated by squeezing the compressible elongated tubular housing 5 at or near the sliding piston 3.

Figure 3:
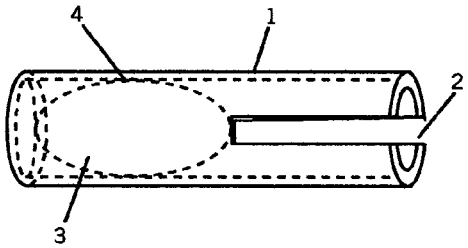
FIG. 3 shows an enlarged view of the sliding piston opening means in the closed position.
Figure 5:
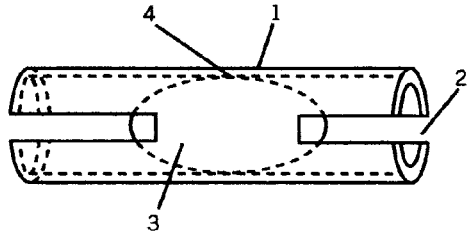
FIG. 5 shows an enlarged view of another embodiment of the sliding piston opening means in the closed position.
Figure 4:
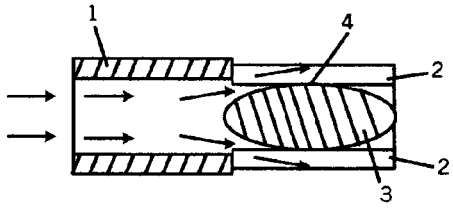
FIG. 4 shows a detailed cross-sectional view of the sliding piston opening means in the open position.

In the closed position, the sliding piston 3 is located near the end of the tube 1 without the opening 2 as shown in FIGS. 3 and 5. With pressure from the fingertip pressing on the compressible elongated tubular housing 5 at or near the end of the sliding piston 3 near the end of the tube 1 without the opening 2, the sliding piston 3 will be urged toward the end of the tube 1 with the opening 2. As shown in FIG. 4, when the sealing circumference 4 of the sliding piston 3 is urged past the opening 2, a fluid flow path is exposed to allow the fluid 8 within the compressible elongated tubular housing 5 to be released through the sliding piston opening means and out of the compressible elongated tubular housing 5. When pressure is applied to the fluid 8 in the compressible elongated tubular housing 5 by squeezing the compressible elongated tubular housing 5, the fluid 8 will be urged out of the compressible elongated tubular housing 5. The sliding piston 3 may be urged back to its closed position by pressure from the fingertip from the other end of the sliding piston 3.

When the compressible elongated tubular housing 5 has a small cross-section such that the fluid 8 within it cannot be reliably released simply by opening the sliding piston opening means due to its surface tension, a surface tension disrupting member may be utilized to increase the capillary action and to overcome the surface tension of the fluid 8 to reliably release the fluid 8 from the compressible elongated tubular housing 5 even without squeezing the compressible elongated tubular housing 5. The surface tension disrupting member is an elongated member inserted in the compressible elongated tubular housing 5 and may be affixed to the sealed end 6 of the compressible elongated tubular housing 5.

Figure 6:
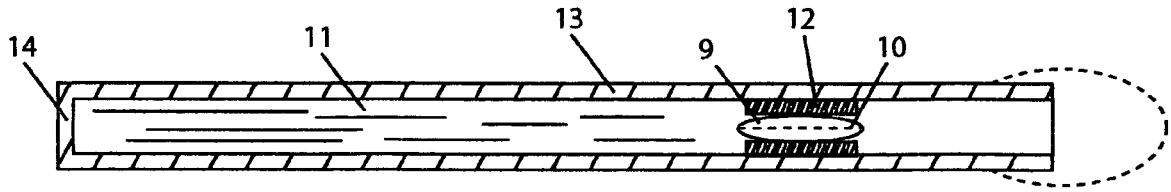
FIG. 6 shows a cross-sectional view of another embodiment of the sliding piston opening means in the closed position.
Figure 7:
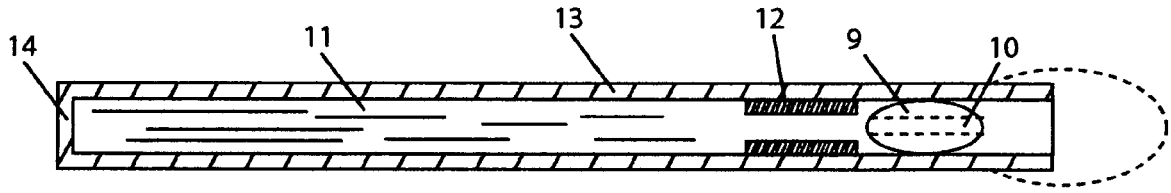
FIG. 7 shows a cross-sectional view of the embodiment of the sliding piston opening means shown in FIG. 6 in the open position.
Figure 8:
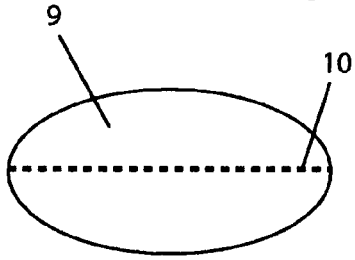
FIG. 8 shows an enlarged view of the sliding piston opening means in the closed position shown in FIG. 6.
Figure 9:
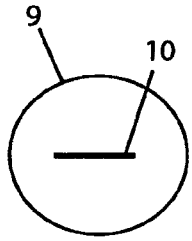
FIG. 9 shows an enlarged end view of the sliding piston opening means in the closed position shown in FIGS. 6 and 8.
Figure 10:
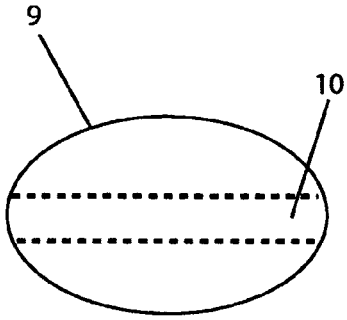
FIG. 10 shows an enlarged view of the sliding piston opening means in the open position shown in FIG. 7.
Figure 11:
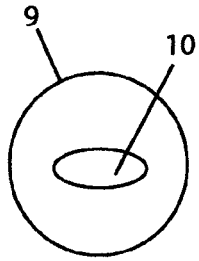
FIG. 11 shows an enlarged end view of the sliding piston opening means in the open position shown in FIGS. 7 and 10.

FIGS. 6, 7, 8, 9, 10, and 11 show another embodiment of the sliding piston opening means. In this embodiment, the sliding piston 9 is made of an elastic material such as rubber. The sliding piston 9 has a generally elliptical shape with a through opening 10 through its length which will allow fluid 11 to flow from one end of the sliding piston 9 to the other end of the sliding piston 9. The sliding piston 9 is inserted at a restrictive opening 12 within the compressible elongated tubular housing 13 as shown in FIG. 6. The restrictive opening 12 will compress the sliding piston 9 to a circular profile as shown in FIG. 9 thereby closing the opening 10 through the sliding piston 9. This will seal a fluid 11 within the elongated tubular housing 13 between the sliding piston opening means and the sealed end 14 of the elongated tubular housing 13. When pressure is applied to either end of the sliding piston 9, the sliding piston 9 will be urged to move away from the restrictive opening 12 as shown in FIG. 7. When the sliding piston 9 is released from the restrictive opening 12, the sliding piston 9 will expand to its original elliptical shape thereby expanding the opening 10 through its length as shown in FIGS. 10 and 11 to allow passage of the fluid 11 in the elongated tubular housing 13. The expanded sliding piston 9, with its elliptical shape will remain captured in the elongated tubular housing 13 due to the interference fit between its elliptical profile and the elongated tubular housing's circular profile.

Figure 12:
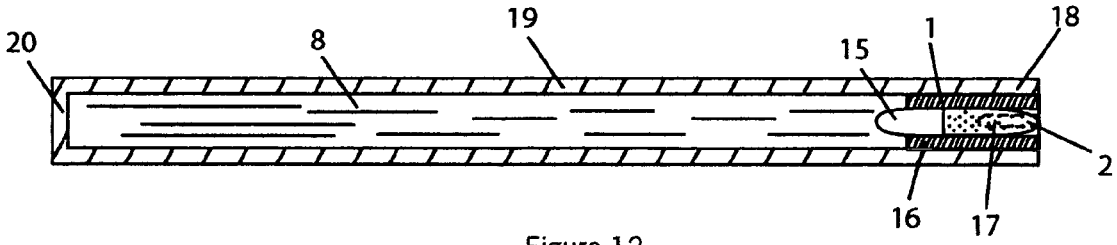
FIG. 12 shows a cross-sectional view of another embodiment of the sliding piston opening means in the closed position.
Figure 13:
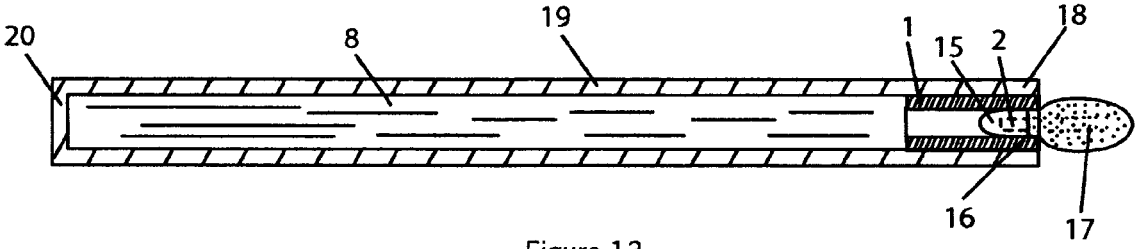
FIG. 13 shows a cross-sectional view of the embodiment of the sliding piston opening means shown in FIG. 12 in the open position.

FIGS. 12 and 13 show another embodiment of the sliding piston opening means. In this embodiment, the sliding piston opening means comprises a section of a tube 1 with an opening 2 such as a slit through part of its length with an elliptical shaped piston 15 with a sealing diameter 16 between its two ends approximately that of the inside diameter of the tube 1 disposed within the tube 1. An applicator tip 17 such as a cotton swab or a foam material is affixed to one end of the sliding piston 15. An O-ring may be disposed at the sealing diameter 16 to provide the sealing function. The sliding piston opening means is affixed near an open end 18 of a compressible elongated tubular housing 19 with a sealed end 20 and an open end 18 and with approximately the same inside diameter as the outside diameter of the sliding piston opening means. A fluid 8 is enclosed within the compressible elongated tubular housing 19 near the sealed end 20. The sliding piston opening means separates the fluid 8 from the open end 18 of the compressible elongated tubular housing 19 thereby sealing the fluid 8 within the compressible elongated tubular housing 19. The sliding piston opening means is operated by squeezing the compressible elongated tubular housing 19 at or near the sliding piston 15.

In the closed position, the elliptical shaped piston 15 with the applicator tip 17 is enclosed near the end 18 of the elongated tubular housing 19. With pressure from the fingertip pressing on the compressible elongated tubular housing 19 at or near the end of the elliptical shaped piston 15 near the end of the tube 1 without the opening 2, the sliding piston 15 will be urged toward the open end 18 of the elongated tubular housing 19. The applicator tip 17 will protrude from within the elongated tubular housing 19 and a fluid flow path is exposed to allow the fluid 8 within the compressible elongated tubular housing 19 to be released through the sliding piston opening means and out of the compressible elongated tubular housing 19 to the applicator tip 17. When pressure is applied to the fluid 8 in the compressible elongated tubular housing 19 by squeezing the compressible elongated tubular housing 19, the fluid 8 will be urged out of the compressible elongated tubular housing 19.

Figure 14:
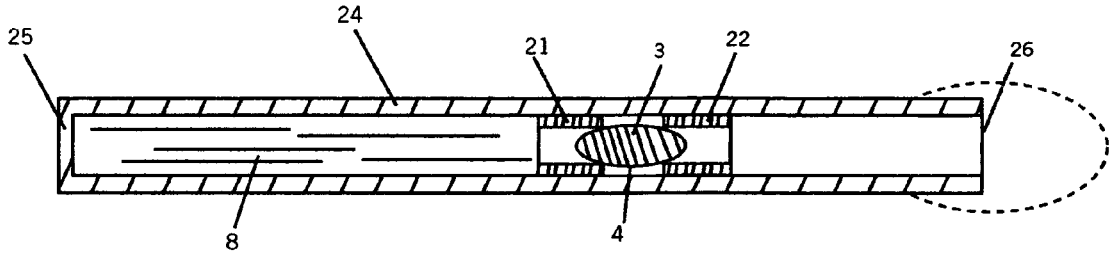
FIG. 14 shows a cross-sectional view of another embodiment of the sliding piston opening means in the closed position.
Figure 15:
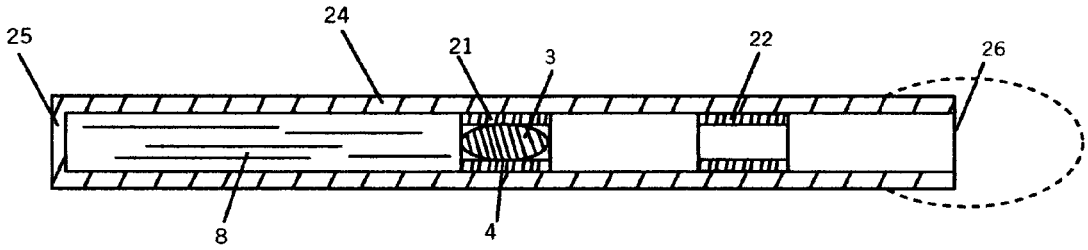
FIG. 15 shows a cross-sectional view of another embodiment of the sliding piston opening means in the closed position.
Figure 16:
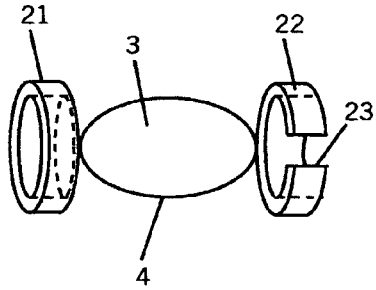
FIG. 16 shows an enlarged view of the sliding piston opening means shown in FIGS. 14 and 15.

FIGS. 14, 15, and 16 show another embodiment of the sliding piston opening means. In this embodiment, the sliding piston opening means comprises of a first short tubular section 21 and a second short tubular section 22 with an opening 23 such as a slit through the second short tubular section 22 with an elliptical shaped piston 3 with a sealing diameter 4 between its two ends approximately that of the inside diameter of the short tubular sections 21, 22 disposed with its sealing diameter 4 positioned within the first short tubular section 21. An O-ring may be disposed at the sealing diameter 4 to provide the sealing function. The sliding piston opening means is affixed inside a compressible elongated tubular housing 24 with a sealed end 25 and an open end 26 and with approximately the same inside diameter as the outside diameter of the sliding piston opening means. A fluid 8 is enclosed within the compressible elongated tubular housing 24 near the sealed end 25. The sliding piston opening means separates the fluid 8 from the open end 26 of the compressible elongated tubular housing 24 thereby sealing the fluid 8 within the compressible elongated tubular housing 24. The sliding piston opening means is operated by squeezing the compressible elongated tubular housing 24 at or near the sliding piston opening means.

In the closed position, the elliptical shaped piston 3 is disposed with its sealing diameter 4 inside the first short tubular section 21 as shown in FIGS. 14 and 15. With pressure from the fingertip pressing on the compressible elongated tubular housing 24 at or near the first short tubular section 21, the sliding piston 3 will be urged toward the second short tubular section 22 with the opening 23. When the sealing circumference 4 of the sliding piston 3 is urged past the end of the first short tubular section 21, a fluid flow path is exposed to allow the fluid 8 within the compressible elongated tubular housing 24 to be released through the sliding piston opening means and out of the compressible elongated tubular housing 24. The elliptical shaped piston 3 may be immediately captured by the second short tubular section 22 after its sealing diameter 4 is urged past the end of the first short tubular section 21. The elliptical shaped piston 3 may also be retained in the area between the first and second short tubular sections 21, 22 without being captured by either section when the first and second short tubular sections 21, 22 are disposed further apart than the length of the elliptical shaped piston 3.

When the compressible elongated tubular housing 24 has a small cross-section such that the fluid 8 within it cannot be reliably released simply by opening the sliding piston opening means due to its surface tension, a surface tension disrupting member may be utilized to increase the capillary action and to overcome the surface tension of the fluid 8 to reliably release the fluid 8 from the compressible elongated tubular housing 24 even without squeezing the compressible elongated tubular housing 24. The surface tension disrupting member is an elongated member inserted in the compressible elongated tubular housing 24 and may be affixed to the sealed end 25 of the compressible elongated tubular housing 24.

Figure 17:
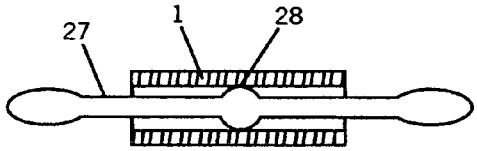
FIG. 17 shows an enlarged cross-sectional view of another embodiment of the sliding piston opening means in the closed position.
Figure 18:
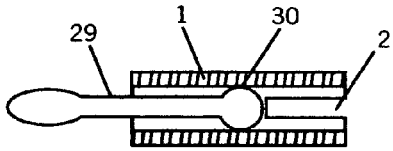
FIG. 18 shows an enlarged cross-sectional view of another embodiment of the sliding piston opening means in the closed position.

FIGS. 17 and 18 show another alternative embodiment of the sliding piston opening means. In this alternative embodiment, the sliding piston opening means comprises of a section of a tube 1 with an opening 2 such as a slit through part of its length with a piston 27 with two ends that are generally in an elliptical shape as shown in FIG. 17 and with a sealing diameter 28 between the two ends that is approximately that of the inside diameter of the tube 1 disposed with the sealing diameter 28 inside the tube 1 away from the end with the opening 2. As in previously disclosed embodiments, the sliding piston opening means is affixed inside a compressible elongated tubular housing with a sealed end and an open end and with approximately the same inside diameter as the outside diameter of the sliding piston opening means. A fluid is enclosed within the compressible elongated tubular housing near the sealed end. The sliding piston opening means separates the fluid from the open end of the compressible elongated tubular housing thereby sealing the fluid within the compressible elongated tubular housing. The sliding piston opening means is operated by squeezing the compressible elongated tubular housing at or near the sliding piston opening means.

In the closed position, the sealing diameters 28, 30 of the pistons 27, 29 are located near the end of the tube 1 without the opening 2. With pressure from the fingertip pressing on the compressible elongated tubular housing at or near the sliding piston opening means, the pistons 27, 29 will be urged toward the end of the tube 1 with the opening 2. When the sealing circumferences 28, 30 of the pistons 27, 29 are urged past the opening 2, a fluid flow path is exposed to allow the fluid 8 within the compressible elongated tubular housing to be released through the sliding piston opening means and out of the compressible elongated tubular housing.

When the compressible elongated tubular housing has a small cross-section such that the fluid within it cannot be reliably released simply by opening the sliding piston opening means due to its surface tension, a surface tension disrupting member may be utilized to increase the capillary action and to overcome the surface tension of the fluid to reliably release the fluid from the compressible elongated tubular housing even without squeezing the compressible elongated tubular housing. The surface tension disrupting member is an elongated member inserted in the compressible elongated tubular housing and may be affixed to the sealed end of the compressible elongated tubular housing.

Figure 19:
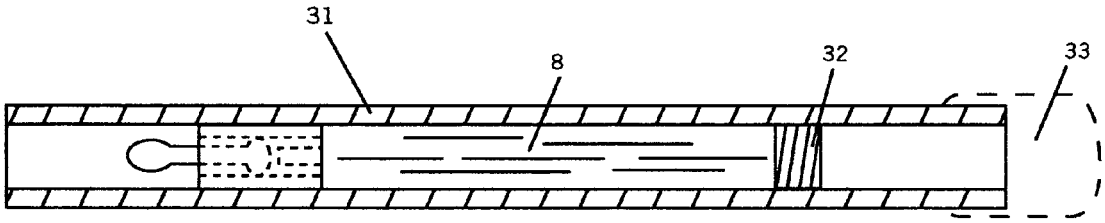
FIG. 19 shows a cross-sectional view of another embodiment of the sliding piston opening means in the closed position.

FIG. 19 shows another embodiment of the sliding piston opening means. In this embodiment, the sliding piston opening means shown in FIG. 18 is affixed within an elongated tubular housing 31 with two open ends. A fluid 8 is sealed within the elongated tubular housing 31 between the sliding piston opening means and a viscous substance 32 such as silicone. When the sliding piston opening means is opened, the fluid 8 will be released from the elongated tubular housing 31 by gravity through the end that is directed downward. An applicator tip 33 such as a cotton swab, a sponge, or a brush may be affixed to the desired open end of the elongated tubular housing 31.

Figure 20:
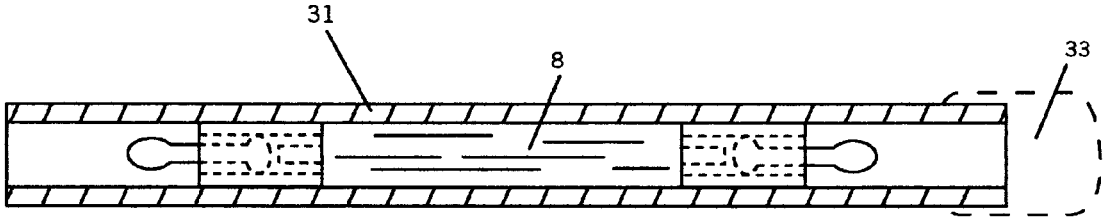
FIG. 20 shows a cross-sectional view of another embodiment of the sliding piston opening means in the closed position.

FIG. 20 shows another embodiment of the sliding piston opening means. In this embodiment, a sliding piston opening means as shown in FIG. 18 is affixed within an elongated tubular housing 31 near each of its two open ends. A fluid 8 is sealed within the elongated tubular housing 31 between the two sliding piston opening means. When both of the sliding piston opening means are opened, the fluid 8 will be released from the elongated tubular housing 31 by gravity through the end that is directed downward. An applicator tip 33 such as a cotton swab, a sponge, or a brush may be affixed to the desired open end of the elongated tubular housing 31.

Figure 21:
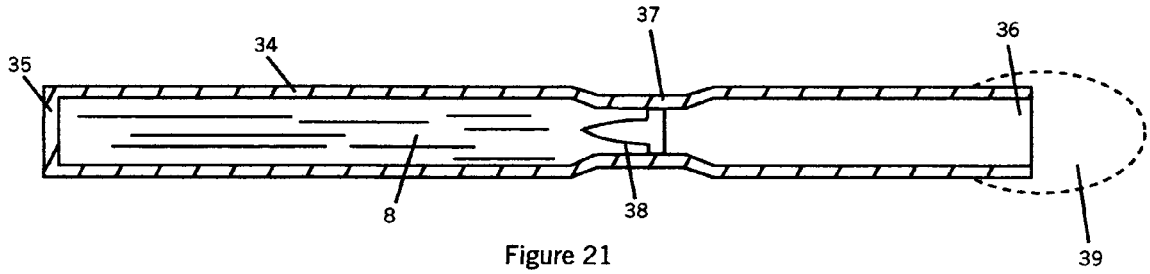
FIG. 21 shows a cross-sectional view of another embodiment of the sliding piston opening means in the closed position.
Figure 22:
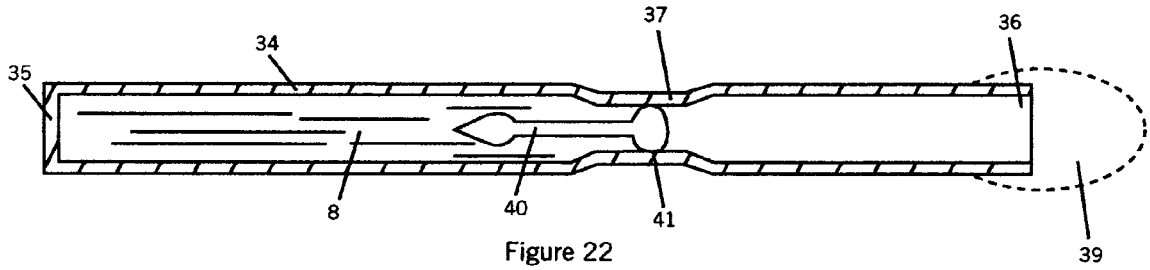
FIG. 22 shows a cross-sectional view of another embodiment of the sliding piston opening means in the closed position.

FIG. 21 shows another embodiment of the sliding piston opening means wherein the compressible elongated tubular housing 34 with a sealed end 35 and an open end 36 has a restrictive opening 37 between its two ends 35, 36. A sliding piston 38 is disposed at the restrictive opening 37 to seal a fluid 8 within the elongated tubular housing 34. Upon squeezing of the elongated tubular housing 34 at or near the sliding piston 38 the sliding piston 38 will move from its position at the restrictive opening 37 to a position away from the restrictive opening 37 thereby exposing a fluid flow path from the fluid 8 to the open end 36 of the elongated tubular housing 34. An applicator tip 39 such as a cotton swab or a foam tip may be affixed to the open end 36 of the elongated tubular housing 34. FIG. 22 shows another variation of the sliding piston opening means shown in FIG. 21. In this embodiment, the sliding piston 40 has an elongated extension with a sealing diameter 41 at one end and an elliptical terminal at the other end. The sealing diameter 41 is disposed within the restrictive opening 37 in the elongated tubular housing 34 to seal a fluid 8 within the elongated tubular housing 34. The elliptical terminal enables the moving of the sliding piston 40 from a location away from the restrictive opening 37.

Figure 23:
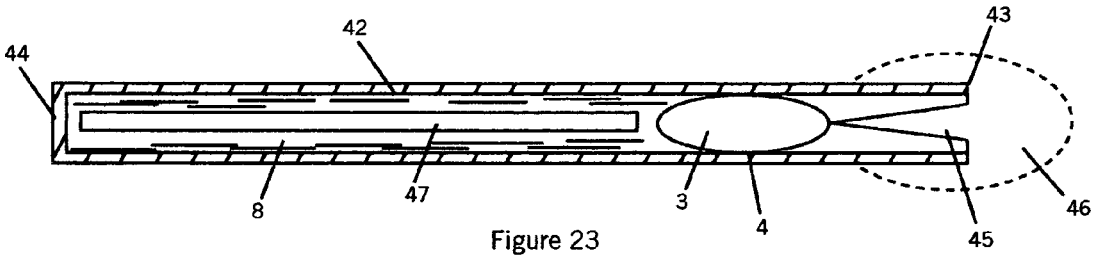
FIG. 23 shows a cross-sectional view of another embodiment of the sliding piston opening means in the closed position.

FIG. 23 shows another embodiment of the sliding piston opening means in a compressible elongated tubular housing 42 with an open end 43 and a sealed end 44. An opening 45 such as a slit, a v-shaped cut, or a hole is formed near the open end 43 of the elongated tubular housing 42. A sliding piston 3 with a sealing diameter 4 approximately that of the inside diameter of the elongated tubular housing 42 is disposed near the open end 43 of the elongated tubular housing 42 between the fluid 8 and the opening 45 near the open end 43 of the elongated tubular housing 42. When the sliding piston 3 is urged by finger pressure towards the open end 43 of the elongated tubular housing 42 and pass the opening 45 near the open end 43 of the elongated tubular housing 42 a fluid flow path is exposed for release of the fluid 8 enclosed in the elongated tubular housing 42. The open end 43 and the opening 45 near the open end 43 of the elongated tubular housing 42 is covered by an applicator tip 46 such as a cotton swab or foam tip. The fluid 8 is released from the elongated tubular housing 42 into the applicator tip 46 for application.

When the elongated tubular housing 42 has a small cross-section such that the fluid 8 within it cannot be reliably released simply by opening the sliding piston opening means due to its surface tension, a surface tension disrupting member 47 may be utilized to increase the capillary action and to overcome the surface tension of the fluid 8 to reliably release the fluid 8 from the compressible elongated tubular housing 42 even without squeezing the compressible elongated tubular housing 42. The surface tension disrupting member 47 is an elongated member inserted in the compressible elongated tubular housing 42 and may be affixed to the sealed end 44 of the compressible elongated tubular housing 42.

Figure 24:
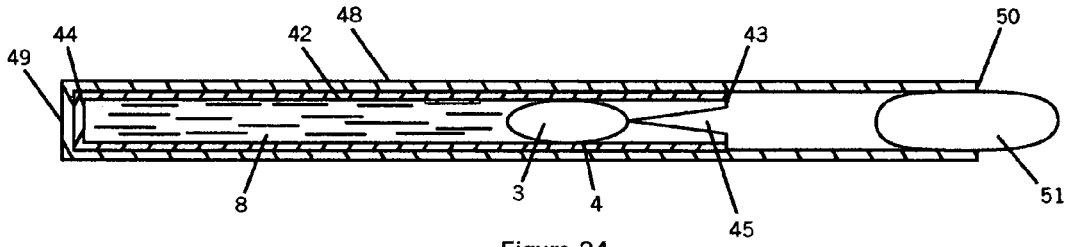
FIG. 24 shows a cross-sectional view of another embodiment of the sliding piston opening means in the closed position.

FIG. 24 shows another variation of the embodiment of the sliding piston opening means shown in FIG. 23. In this embodiment, the structure of the sliding piston opening means shown in FIG. 23 without the applicator tip 46 is disposed within a second elongated tubular housing 48 with a sealed end 49 and an open end 50. An applicator tip 51 such as a cotton swab or a foam tip is affixed inside the open end 50 of the second elongated tubular housing 48 and extends outside of the open end 50 of the second elongated tubular housing 48. When the sliding piston opening means is opened the fluid 8 will be released into the second elongated tubular housing 48 and into the applicator tip 51. The first elongated tubular housing 42 and the second elongated tubular housing 48 may also be formed as a single unit whereby a single elongated tubular housing with a smaller inside diameter near the sealed end and a larger inside diameter near the open end is formed.

Figure 25:
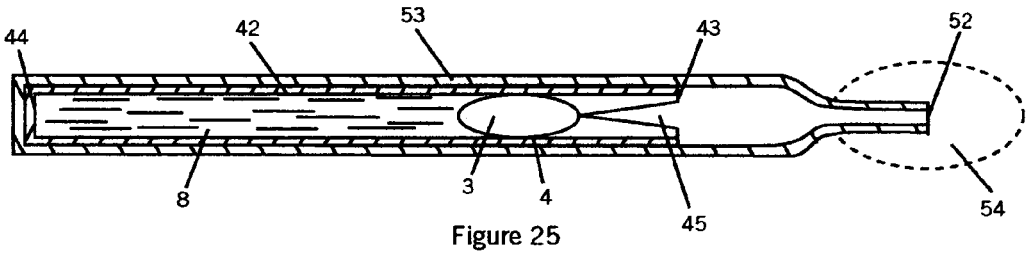
FIG. 25 shows a cross-sectional view of another embodiment of the sliding piston opening means in the closed position.

FIG. 25 shows yet another variation of the embodiment of the sliding piston opening means shown in FIG. 24. In this embodiment, the open end 52 of the second elongated tubular housing 53 has a reduced diameter to allow a smaller applicator tip 54 to be affixed to the open end 52.

Figure 26:
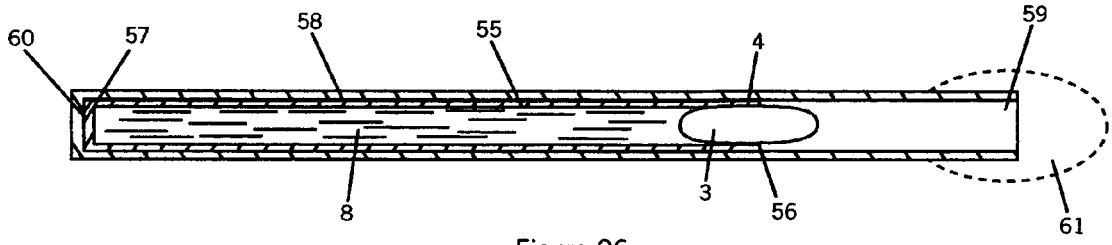
FIG. 26 shows a cross-sectional view of another embodiment of the sliding piston opening means in the closed position.

FIG. 26 shows another embodiment of the sliding piston opening means. In this embodiment, a sliding piston 3 with a sealing diameter 4 approximately that of the inside diameter of a first elongated tubular housing 55 is disposed near an open end 56 of the first elongated tubular housing 55 with an open end 56 and a sealed end 57. The sliding piston 3 seals a fluid 8 inside the first elongated tubular housing 55 near the sealed end 57 of the first elongated tubular housing 55. The first elongated tubular housing 55 is disposed within a second elongated tubular housing 58 with an open end 59 and a sealed end 60. The sealed end 57 of the first elongated tubular housing 55 is disposed near the sealed end 60 of the second elongated tubular housing 58. The open end 59 of the second elongated tubular housing 58 is covered with an applicator tip 61 such as a cotton swab or a foam tip. When the sliding piston 3 is urged by finger pressure pass the open end 56 of first elongated tubular housing 55, a fluid flow path is exposed for release of the fluid 8 enclosed in the first elongated tubular housing 55. The fluid 8 will be released from the elongated tubular housings 55, 58 into the applicator tip 61 for application.

When the elongated tubular housing has a small cross-section such that the fluid 8 within it cannot be reliably released simply by opening the sliding piston opening means due to its surface tension, a surface tension disrupting member may be utilized to increase the capillary action and to overcome the surface tension of the fluid 8 to reliably release the fluid 8 from the compressible elongated tubular housing 55 even without squeezing the compressible elongated tubular housing 55. The surface tension disrupting member is an elongated member inserted in the compressible elongated tubular housing 55 and may be affixed to the sealed end 57 of the compressible elongated tubular housing 55.

Figure 27:
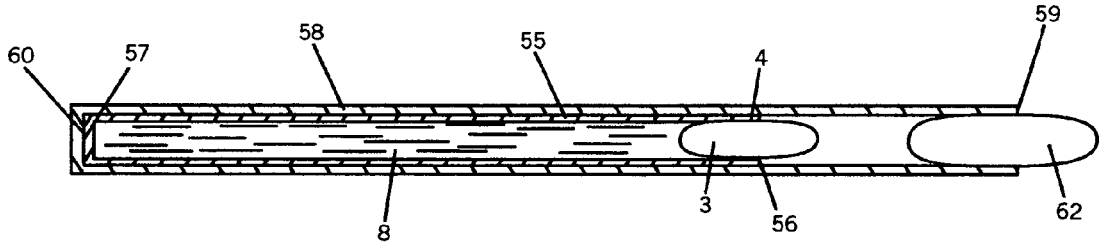
FIG. 27 shows a cross-sectional view of another embodiment of the sliding piston opening means in the closed position.

FIG. 27 shows another variation of the embodiment of the sliding piston opening means shown in FIG. 26. In this embodiment, an applicator tip 62 such as a cotton swab or a foam tip is affixed inside the open end 59 of the second elongated tubular housing 58 and extends outside of the open end 59 of the second elongated tubular housing 58. When the sliding piston opening means is opened the fluid 8 will be released into the second elongated tubular housing 58 and into the applicator tip 62. The first elongated tubular housing 55 and the second elongated tubular housing 58 may also be formed as a single unit whereby a single elongated tubular housing with a smaller inside diameter near the sealed end and a larger inside diameter near the open end is formed.

Figure 28:
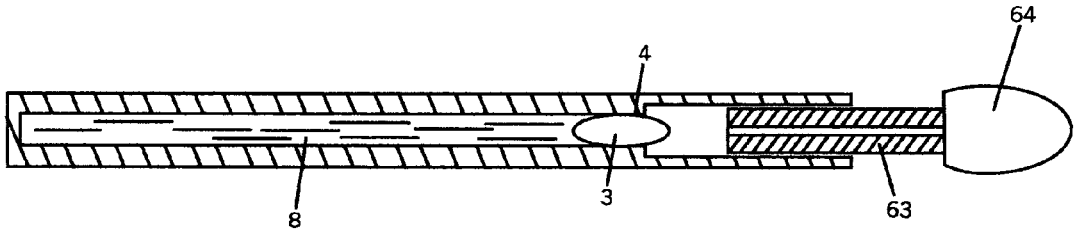
FIG. 28 shows a cross-sectional view of another embodiment of the sliding piston opening means in the closed position.

FIG. 28 shows another variation of the embodiment of the sliding piston opening means shown in FIG. 27. In this embodiment, the applicator in FIG. 27 is replaced with a swab applicator comprising an elongated hollow tube 63 with an applicator tip 64 affixed to one end. The outside diameter of the elongated hollow tube 63 is approximately that of the inside diameter of the open end of the elongated tubular housing. The swab applicator is inserted and affixed with the end opposite the applicator tip 64 inside the open end of the elongated tubular housing. In this embodiment, a rigid elongated hollow tube 63 may be used with the applicator tip 64 to provide a more rigid handle.

Figure 29:
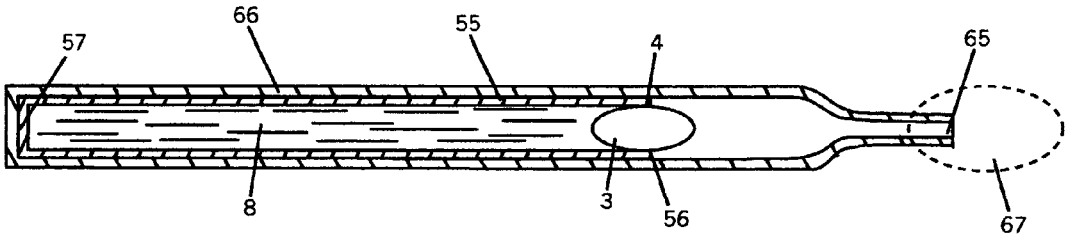
FIG. 29 shows a cross-sectional view of another embodiment of the sliding piston opening means in the closed position.

FIG. 29 shows yet another variation of the embodiment of the sliding piston opening means shown in FIG. 26. In this embodiment, the open end 65 of the second elongated tubular housing 66 has a reduced diameter to allow a smaller applicator tip 67 to be affixed to the open end 65. The first elongated tubular housing 55 and the second elongated tubular housing 66 may also be formed as a single unit whereby a single elongated tubular housing with a smaller inside diameter near the sealed end and a larger inside diameter near the open end with the open end of the single elongated tubular housing formed with a reduced diameter.

Figure 30:
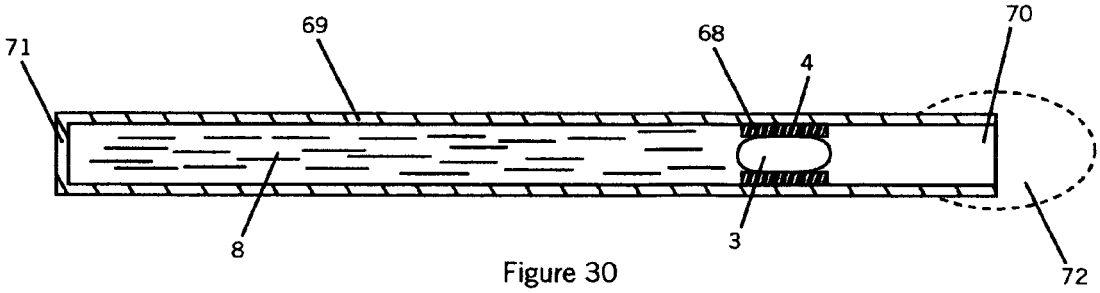
FIG. 30 shows a cross-sectional view of another embodiment of the sliding piston opening means in the closed position.

FIG. 30 shows another embodiment of the sliding piston opening means. In this embodiment, a sliding piston 3 with a sealing diameter 4 approximately that of a restriction 68 inside an elongated tubular housing 69 is disposed at the restriction 68 in the elongated tubular housing 69. The elongated tubular housing 69 has an open end 70 and a sealed end 71. The sliding piston 3 seals a fluid 8 inside the elongated tubular housing 69 near the sealed end 71 of the elongated tubular housing 69. The open end 70 of the elongated tubular housing 69 is covered with an applicator tip 72 such as a cotton swab or a foam tip. When the sliding piston 3 is urged by finger pressure away from the restriction 68 inside the elongated tubular housing 69, a fluid flow path is exposed for release of the fluid 8 enclosed in the elongated tubular housing 69. The fluid 8 will be released from the elongated tubular housing 69 into the applicator tip 72 for application.

When the elongated tubular housing 69 has a small cross-section such that the fluid 8 within it cannot be reliably released simply by opening the sliding piston opening means due to its surface tension, a surface tension disrupting member may be utilized to increase the capillary action and to overcome the surface tension of the fluid 8 to reliably release the fluid 8 from the compressible elongated tubular housing 69 even without squeezing the compressible elongated tubular housing 69. The surface tension disrupting member is an elongated member inserted in the compressible elongated tubular housing 69 and may be affixed to the sealed end 71 of the compressible elongated tubular housing 69.

Figure 31:
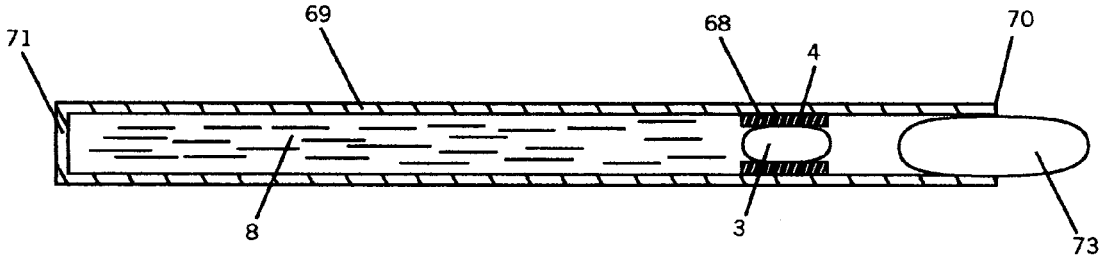
FIG. 31 shows a cross-sectional view of another embodiment of the sliding piston opening means in the closed position.

FIG. 31 shows another variation of the embodiment of the sliding piston opening means shown in FIG. 30. In this embodiment, an applicator tip 73 such as a cotton swab or a foam tip is affixed inside the open end 70 of the elongated tubular housing 69 and extends outside of the open end 70 of the elongated tubular housing 69. When the sliding piston opening means is opened the fluid 8 will be released into the applicator tip 73.

Figure 32:
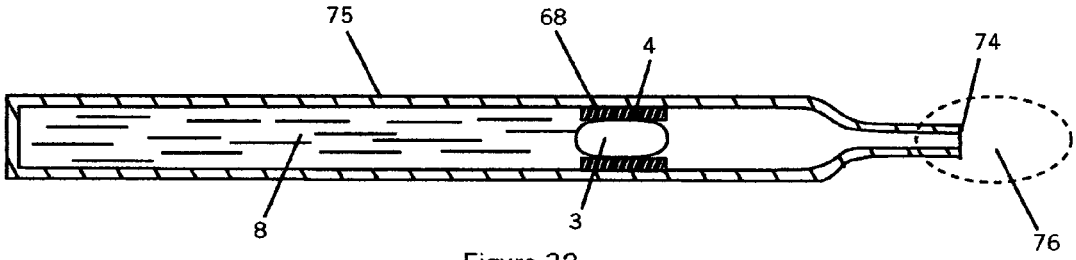
FIG. 32 shows a cross-sectional view of another embodiment of the sliding piston opening means in the closed position.

FIG. 32 shows yet another variation of the embodiment of the sliding piston opening means shown in FIG. 30. In this embodiment, the open end 74 of the elongated tubular housing 75 has a reduced diameter to allow a smaller applicator tip 76 to be affixed to the open end 74.

Figure 33:
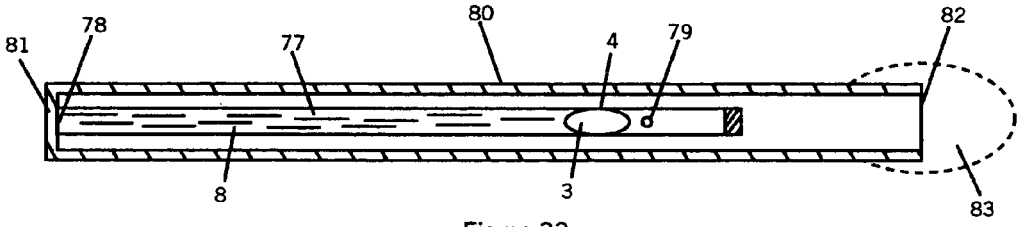
FIG. 33 shows a cross-sectional view of another embodiment of the sliding piston opening means in the closed position.

FIG. 33 shows another embodiment of the sliding piston opening means comprising a first elongated tubular housing 77 with a sealed end 78. An opening 79 such as a slit or a hole is formed near an end of the first elongated tubular housing 77. A sliding piston 3 with a sealing diameter 4 approximately that of the inside diameter of the first elongated tubular housing 77 is disposed near the end of the elongated tubular housing 77 between the fluid 8 and the opening 79. When the sliding piston 3 is urged by finger pressure past the opening 79 in the first elongated tubular housing 77 a fluid flow path is exposed for release of the fluid 8 enclosed in the first elongated housing 77. The first elongated tubular housing 77 is disposed inside a second elongated tubular housing 80 with a sealed end 81 and an open end 82. The open end 82 of the second elongated tubular housing 80 is covered by an applicator tip 83 such as a cotton swab or foam tip. The fluid 8 is released from the elongated tubular housing 77 into the applicator tip 83 for application.

Figure 34:
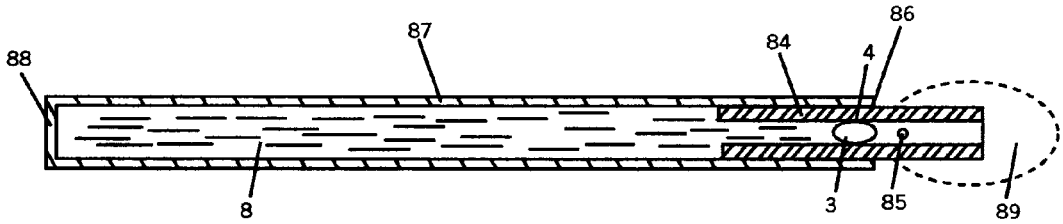
FIG. 34 shows a cross-sectional view of another embodiment of the sliding piston opening means in the closed position.

FIG. 34 shows another embodiment of the sliding piston opening means. In this embodiment, the sliding piston opening means comprises of an elongated tube 84 with an opening 85 such as a slit or a hole through the wall of the elongated tube 84 disposed near one end of the elongated tube 84. A sliding piston 3 with a sealing diameter 4 approximately that of the inside diameter of the elongated tube 84 is disposed in the elongated tube 84. The elongated tube 84 is affixed to an open end 86 of an elongated tubular housing 87 with a sealed end 88 and an open end 86. A fluid 8 is disposed inside the elongated tubular housing 87 near the sealed end 88. The elongated tube 84 is affixed to the open end 86 such that the sliding piston 3 is disposed between the fluid 8 in the elongated tubular housing 87 and the opening 85 in the elongated tube 84. The elongated tube 84 and the sliding piston 3 will seal the open end 86 of the elongated tubular housing 87 and the fluid 8 therein.

When the sliding piston 3 is urged past the opening 85 in the elongated tube 84 a fluid flow path is exposed for release of the fluid 8 enclosed in the elongated tubular housing 87. The opening 85 in the elongated tube 84 is covered by an applicator tip 89 such as a cotton swab or foam tip. The fluid 8 is released from the elongated tubular housing 87 into the applicator tip 89 for application.

Figure 35:
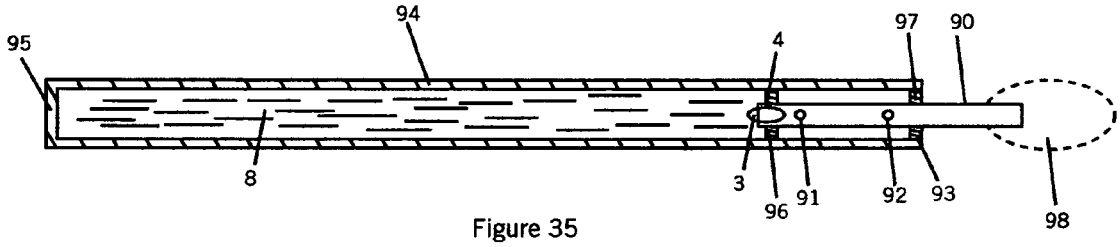
FIG. 35 shows a cross-sectional view of another embodiment of the sliding piston opening means in the closed position.

FIG. 35 shows another embodiment of the sliding piston opening means. In this embodiment, the sliding piston opening means comprises of an elongated tube 90 with two open ends and with two openings 91, 92 such as a slit or a hole through the wall of the elongated tube 90. A sliding piston 3 with a sealing diameter 4 approximately that of the inside diameter of the elongated tube 90 is disposed in the elongated tube 90 at a position not between the two openings 91, 92. The elongated tube 90 is affixed to an open end 93 of an elongated tubular housing 94 with a sealed end 95 and an open end 93. A fluid 8 is disposed in side the elongated tubular housing 94 near the sealed end 95. The elongated tube 90 is affixed to the open end 93 such that the sliding piston 3 is disposed between the fluid 8 in the elongated tubular housing 94 and the openings 91, 92 in the elongated tube 90. The elongated tube 90 and the sliding piston 3 are affix to and seal the open end 93 of the elongated tubular housing 94 and the fluid 8 therein by two sealing surfaces 96, 97 position between the elongated tubular housing 94 and the elongated tube 90 at a locations not between the two openings 91, 92 in the elongated tube 90.

Figure 36:
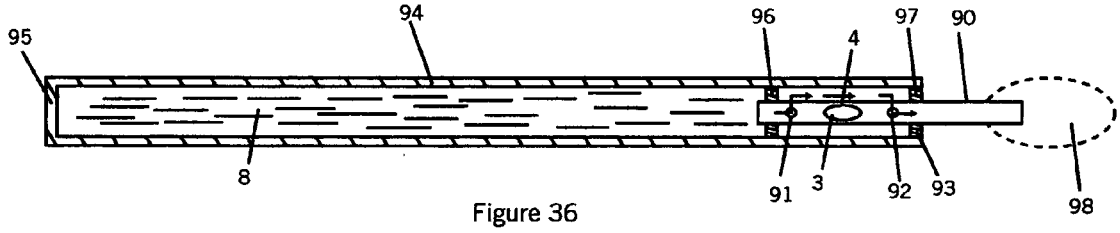
FIG. 36 shows a cross-sectional view of the embodiment of the sliding piston opening means shown in FIG. 35 in the open position.

As shown in FIG. 36, when the sliding piston 3 is urged past the first opening 91 in the elongated tube 90 a fluid flow path is exposed for release of the fluid 8 enclosed in the elongated tubular housing 94. The fluid 8 will flow into the elongated tube 90 and out of the first opening 91 into the space between the walls of the elongated tubular housing 94 and the elongated tube 90. The fluid flow will then reenter the elongated tube 90 through the second opening 92 and out through the open end of the elongated tube 90. The open end of the elongated tube 90 is covered by an applicator tip 98 such as a cotton swab or foam tip. The fluid 8 is released from the elongated tubular housing 94 into the applicator tip 98 for application.

The previously disclosed embodiments of the sliding piston opening means may also be used as specimen collectors if the elongated tubular housing does not contain a fluid 8 initially. This is accomplished by first opening the sliding piston opening means. A pressure is then applied to the compressible elongated tubular housing by squeezing the elongated tubular housing to force most of the air out of the elongated tubular housing. The open end of the elongated tubular housing is then submerged in the specimen to be collected and the pressure on the elongated tubular housing is released to allow the elongated tubular housing to expand thereby creating a partial vacuum inside the elongated tubular housing to enable retrieval of the specimen into the elongated tubular housing. The sliding piston opening means is then closed to seal-in the collected specimen. The collected specimen may then be stored or transported to another location for further testing.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A sliding piston opening means comprising:

a length of tube with one or more openings through part of the length; and a sliding piston with a sealing diameter approximately that of the inside diameter of the length of tube disposed within said length of tube and movable from a first closed position to a second open position at the one or more openings in the length of tube;

wherein the sliding piston opening means is affixed inside a compressible elongated tubular housing with a sealed end and an open end and with approximately the same inside diameter as the outside diameter of the length of tube and wherein a fluid is enclosed within the compressible elongated tubular housing near the sealed end separated from the open end of the compressible elongated tubular housing by said sliding piston opening means thereby sealing the fluid within the compressible elongated tubular housing whereby the sliding piston opening means is operated by squeezing the compressible elongated tubular housing at or near the sliding piston to open and close a fluid path from the fluid to the open end of the compressible elongated tubular housing.

2. A sliding piston opening means as in claim 1, wherein said sliding piston has an elliptical shaped profile.

3. A sliding piston opening means as in claim 1 or 2, wherein said opening in said length of tube is one or more slits through a portion of the length of tube.

4. A sliding piston opening means as in claim 1 or 2, wherein said elongated tubular housing has one or more ends that are covered with an applicator.

5. A sliding piston opening means as in claim 1 or 2 wherein said length of tube and said compressible elongated tubular housing are formed as a single unit with the length of tube in the form of a reduced diameter within the compressible elongated tubular housing.

* * * * *